US006088303A

United States Patent [19]

Oishi

[11] Patent Number: 6,088,303

[45] Date of Patent: Jul. 11, 2000

[54] TIME RECORDER

[75] Inventor: Katsumi Oishi, Tokyo, Japan

[73] Assignee: Seiko Precision Inc., Chiba-ken, Japan

[21] Appl. No.: 08/287,758

[22] Filed: Aug. 9, 1994

Related U.S. Application Data

[63] Continuation of application No. 07/985,783, Dec. 4, 1992, abandoned.

[30] Foreign Application Priority Data

Dec. 11, 1991 [JP] Japan ..... 3-327761

[51] Int. Cl.[7] ..... G04B 45/00

[52] U.S. Cl. ..... 368/41; 368/107

[58] Field of Search ..... 368/41–44; 386/80–86

[56] References Cited

U.S. PATENT DOCUMENTS 4,323,771 4/1982 Chalker, Jr. ..... 346/80

FOREIGN PATENT DOCUMENTS 62-278692 12/1987 Japan .
63-5558 1/1988 Japan .
38094 1/1991 Japan .
3110569 11/1991 Japan .

*Primary Examiner*—Bernard Roskoski
*Attorney, Agent, or Firm*—Jordan and Hamburg LLP

[57] ABSTRACT

When a time card is inserted in a time recorder at the time of ending work, a time recorder calculates the hours worked in one day based on the time of starting work on the same day. A control circuit then outputs the data of the new remaining required work hours calculated by subtracting the hours worked in the day from the remaining required work hours stored in a memory circuit, and a printer prints the time corresponding to the data of the new remaining required work hours onto a specific printing column of the time card.

14 Claims, 6 Drawing Sheets

| No. | Name |
|---|---|
| Dept | |

Time card (Front)

Year month

| Date | Shift | Starting time I | Ending time I | Starting time II | Ending time II | Remaining Hours |
|---|---|---|---|---|---|---|
| 1 | | 9:22 | 17:38 | | | 176.00 |
| 2 | | 12:08 | 19:58 | | | 169.50 |
| 3 | | 9:45 | 15:32 | | | 163.25 |
| 4 | | 7:58 | 19:45 | | | 152.50 |
| 5 | | 15:32 | | | | |
| 6 | | | 9:24 | | | 137.00 |
| | | | | | | |
| 8 | | 9:24 | 17:49 | | | 129.75 |
| 9 | | 9:18 | 22:19 | | | 118.25 |
| 10 | | 13:16 | 19:02 | | | 112.50 |
| 11 | | 14:25 | | | | |
| 12 | | | 9:48 | | | 96.75 |
| | | | | | | |
| | | | | | | |
| 15 | | 12:02 | 19:58 | | | 91.00 |
| 16 | | 9:22 | 13:35 | | | 87.00 |
| 17 | | 9:24 | 22:38 | | | 75.50 |
| | | | | | | |
| | | | | | | |
| | | | | | | |

| Date | Item No. | Contents of revision | Date | Item No. | Contents of revision |
|---|---|---|---|---|---|
| | | | | | |
| | | | | | |
| | | | | | |
| | | | | | |
| | | | | | |
| | | | | | |

Ⓨ Shift ⓪ ① ② ③ ④ ⑤ ⑥ ⑦ ⑧ ⑨

1 ⓪ ① ② ③ ④ ⑤ ⑥ ⑦ ⑧ ⑨

10 ⓪ ① ② ③ ④ ⑤ ⑥ ⑦ ⑧ ⑨

100 ⓪ ① ② ③ ④ ⑤ ⑥ ⑦ ⑧ ⑨

Ⓢ Group A ① B ② C ③

Employment classification Full time ① Free lance ②

FIG.4

| No. | Name |
|---|---|
| Dept | |

Time card (Back)

Year Month

| Date | Shift | Starting time I | Ending time I | Starting time II | Ending time II | Remaining Hours |
|---|---|---|---|---|---|---|
| 21 | | 9 : 34 | 17 : 37 | | | 67.75 |
| 22 | | 11 : 54 | | | | |
| 23 | | | 9 : 22 | | | 48.50 |
| 24 | | 9 : 24 | 21 : 34 | | | 37.75 |
| 25 | | 10 : 13 | 19 : 45 | | | 29.25 |
| 26 | | Holidays available | | | | 21.25 |
| | | | | | | |
| 28 | | 9 : 25 | 16 : 53 | | | 14.75 |
| 29 | | 9 : 18 | 21 : 43 | | | 5.00 |
| 30 | | 11 : 01 | 18 : 23 | | | -1.25 |
| 31 | | 9 : 22 | 17 : 38 | | | -8.25 |

| Date | Item | Contents of revision | Date | Item | Contents of revision |
|---|---|---|---|---|---|
| | | | | | |
| | | | | | |
| | | | | | |
| | | | | | |
| | | | | | |
| | | | | | |

Monthly totals · Hourly salary breakdown Year Month

| Working days | Holidays worked | Holidys available | Days absent | Other holidays I | Other holidays II |
|---|---|---|---|---|---|
| 20 | 1 | 1 | 0 | 0 | 0 |

| | | |
|---|---|---|
| Required work hours | 184.00 | |
| Normal overtime | 8.25 | |
| Late night overtime | 0 | |
| Special overtime | 0 | |
| Holiday hours I | 0 | |
| Holiday hours II | 0 | |
| Total hours this month | 192.25 | |

FIG. 5

TIME RECORDER

This application is a continuation of application Ser. No. 07/985,783 filed Dec. 4, 1992, now abandoned.

FIELD OF THE INVENTION

The present invention relates to a time recorder which can be used for flextime.

BACKGROUND OF THE INVENTION

Conventional time recorders exist which print the actual starting and ending work times of a work period, calculate the total of the working hours and overtime hours for each day, and have prestored starting and ending regulation work times. Based on these stored regulation times, starting times later than normal work starting times and ending times earlier than normal work ending times are printed in separate colors.

When, however, required working hours are fixed within a determined period, i.e., when a time recorder of the type described above is utilized by a company in which the required working hours is fixed per week or per month, such as 40 hours per week or 150 hours per month, then each employee must take a troublesome calculation to confirm his own remaining required working hours within the determined period.

SUMMARY OF THE INVENTION

It is, accordingly, an object of the present invention to eliminate the trouble of calculating the remaining required working hours within the determined period, in cases where the required working hours are fixed within a determined period.

According to the present invention, the above mentioned object is achieved by the provision of informing means for informing personnel of remaining required work hours calculated by subtracting finished work hours already engaged within a determined period from the required work hours which must be engaged within said determined period.

Furthermore, said informing means preferably is printing means for printing the remaining required work hours onto a time card.

However, said informing means may also be display means for visually displaying the remaining required work hours.

Or, said informing means may be sound generating means for informing the remaining required work hours by audio voice.

BRIEF DESCRIPTION OF THE DRAWINGS

In order that the invention may be more clearly understood, it will now be disclosed in greater detail with reference to the accompanying drawings, wherein:

FIG. 4 shows one side of a time card which is used in an embodiment of the present invention; and FIG. 5 shows another side of a time card which is used in an embodiment of the present invention.

DESCRIPTION OF THE PREFERRED EMBODIMENTS

Figure 1:
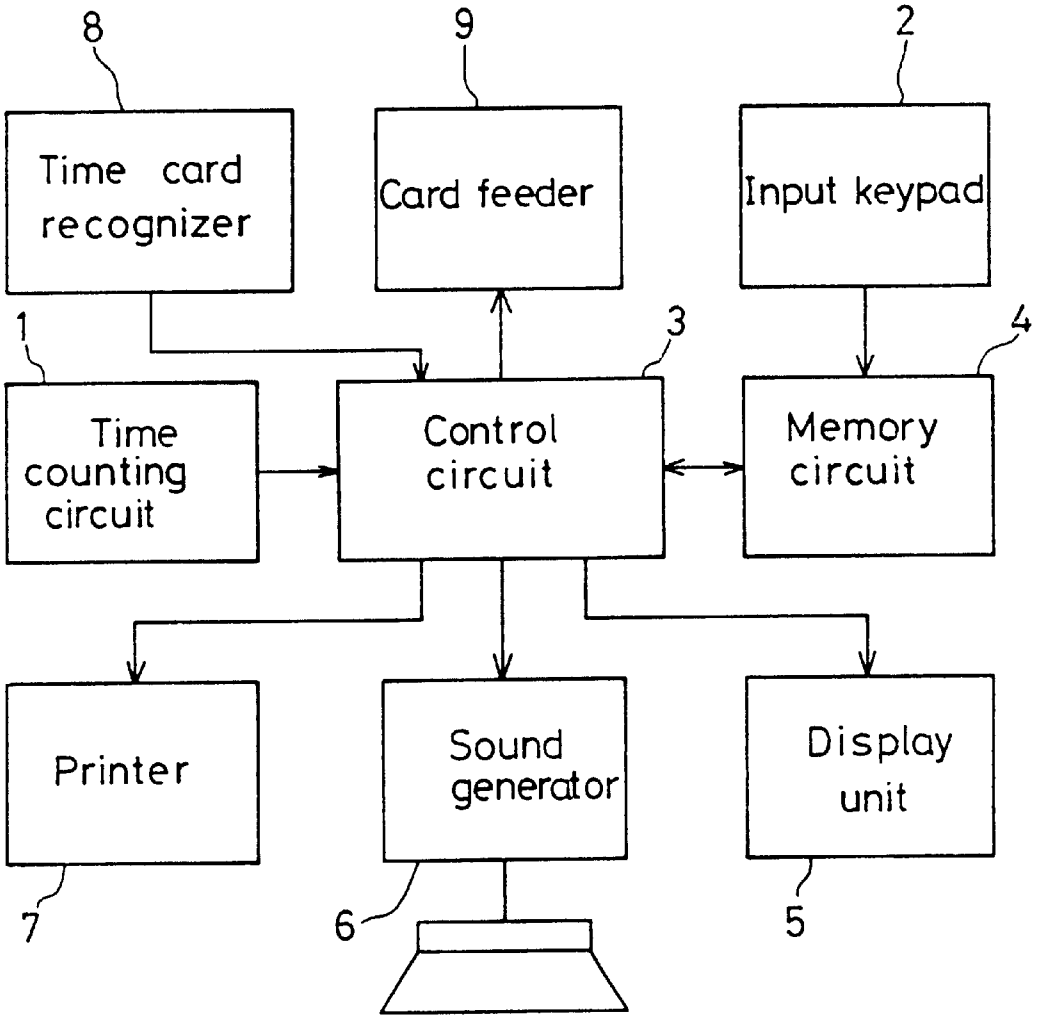
FIG. 1 is a block diagram of an embodiment according to the present invention.

The following is a concrete explanation based on an embodiment of the present invention shown in the drawings.

In FIG. 1, a time counting circuit 1 counts current time and calendar information. An input keypad 2 comprises keys, etc. which are pressed for inputting the number of hours which must be engaged within a determined period. A control circuit 3 is comprised of CPU, ROM, RAM, etc., for generating data of the remaining required work hours that an employee must work which are calculated by subtracting the finished work hours within a determined period from the required work hours within said determined period which were selected using the input keypad 2, and for controlling the various operations. A memory circuit 4 is comprised of, for example, RAM, etc., for storing the data of the required work hours which were entered by the input keypad 2 and the data of the remaining required work hours which were calculated by the control circuit 3, and also for storing the attendance information for each employee, for example, actual work starting time, actual work ending time, number of hours worked within a determined period, etc.

A display unit 5 is comprised of an LCD, etc. for displaying time information, and also displaying the time corresponding to the data of the remaining required work hours which are generated from the control circuit 3. A sound generator 6 comprises a speaker for outputting sound corresponding to the data of the remaining required work hours which are calculated by the control circuit 3. A printer 7 prints the time, etc. corresponding to the data of the actual work starting and ending times and the data of the remaining required work hours which are generated by the control circuit 3, onto a specific printing column of a time card. A time card recognizer 8 reads a section of the inserted time card for recognition of each employee, that is, reads an individual recognition code recorded by punch holes, etc. A card feeder 9 comprises, for example, a motor, etc. for feeding the inserted time card.

Figure 2A:
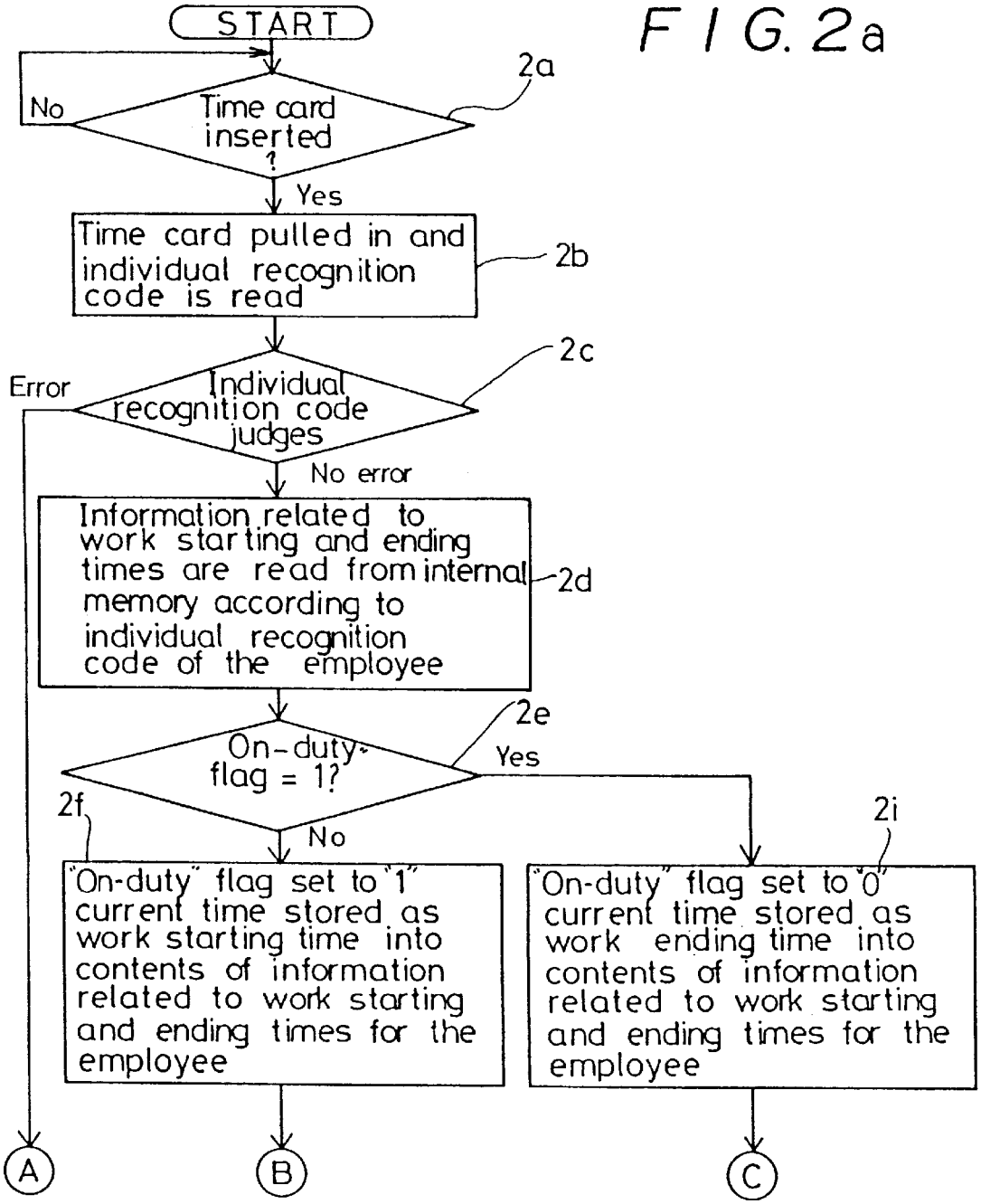
FIGS. 2*a*, and 2*b*, together, represent a flow chart explaining the operation of the embodiment according to FIG. 1.
Figure 2B:
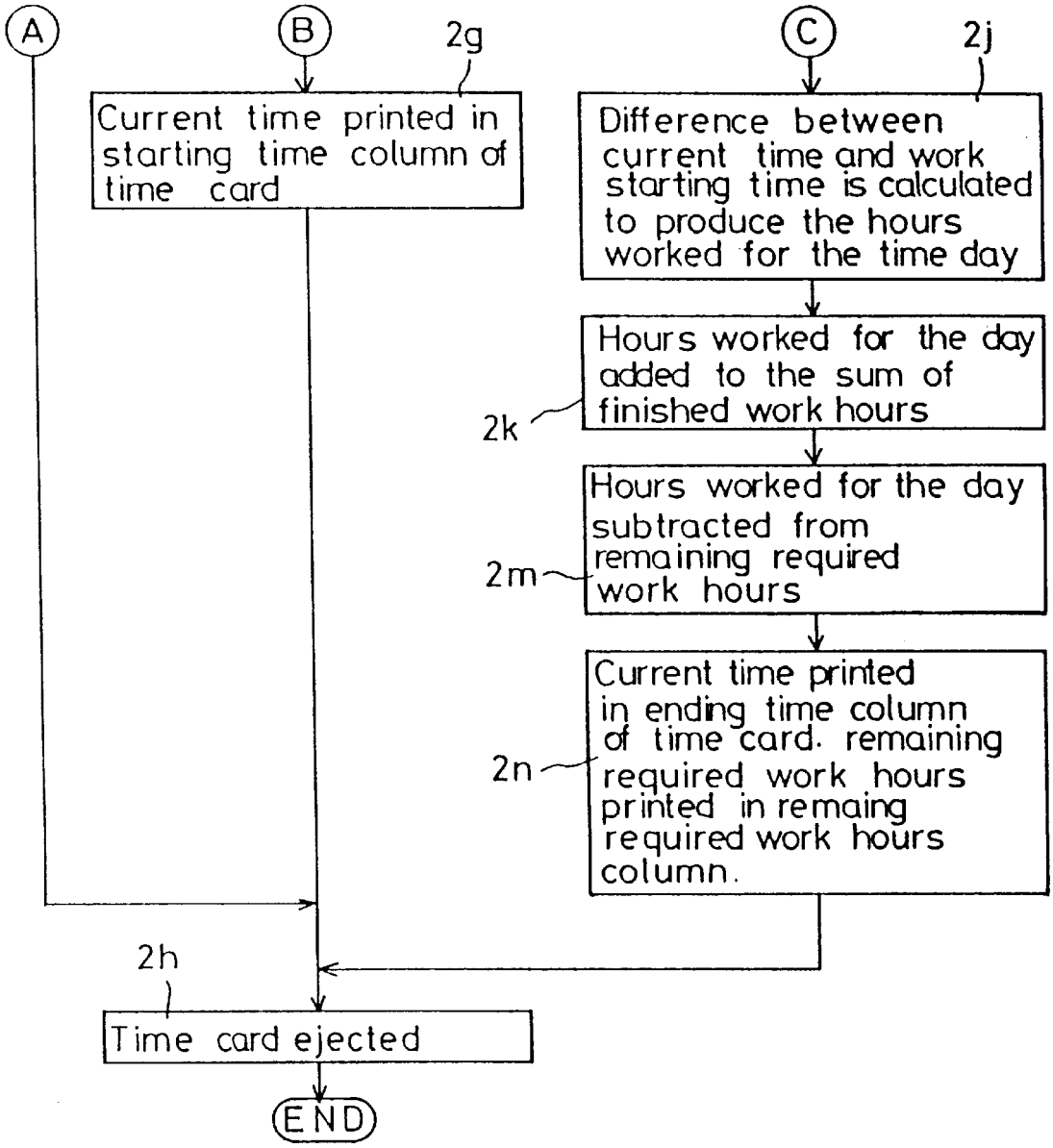

An explanation will now be given of the operation of the embodiment of FIG. 1, with reference to FIGS. 2*a*, and 2*b*.

First, on the first day of the determined period or on a day prior thereto, the supervisor inputs the required working hours using the input keypad 2. For example, if the determined period is one month and the required working hours for the coming month is 184, then 184 hours is entered using the input keypad 2.

This information entered using the input keypad 2 is then stored in a table of the required working hours and the remaining required work hours which are included in the information stored in the memory circuit 4 related to the work starting and ending times for each employee.

Figure 3:
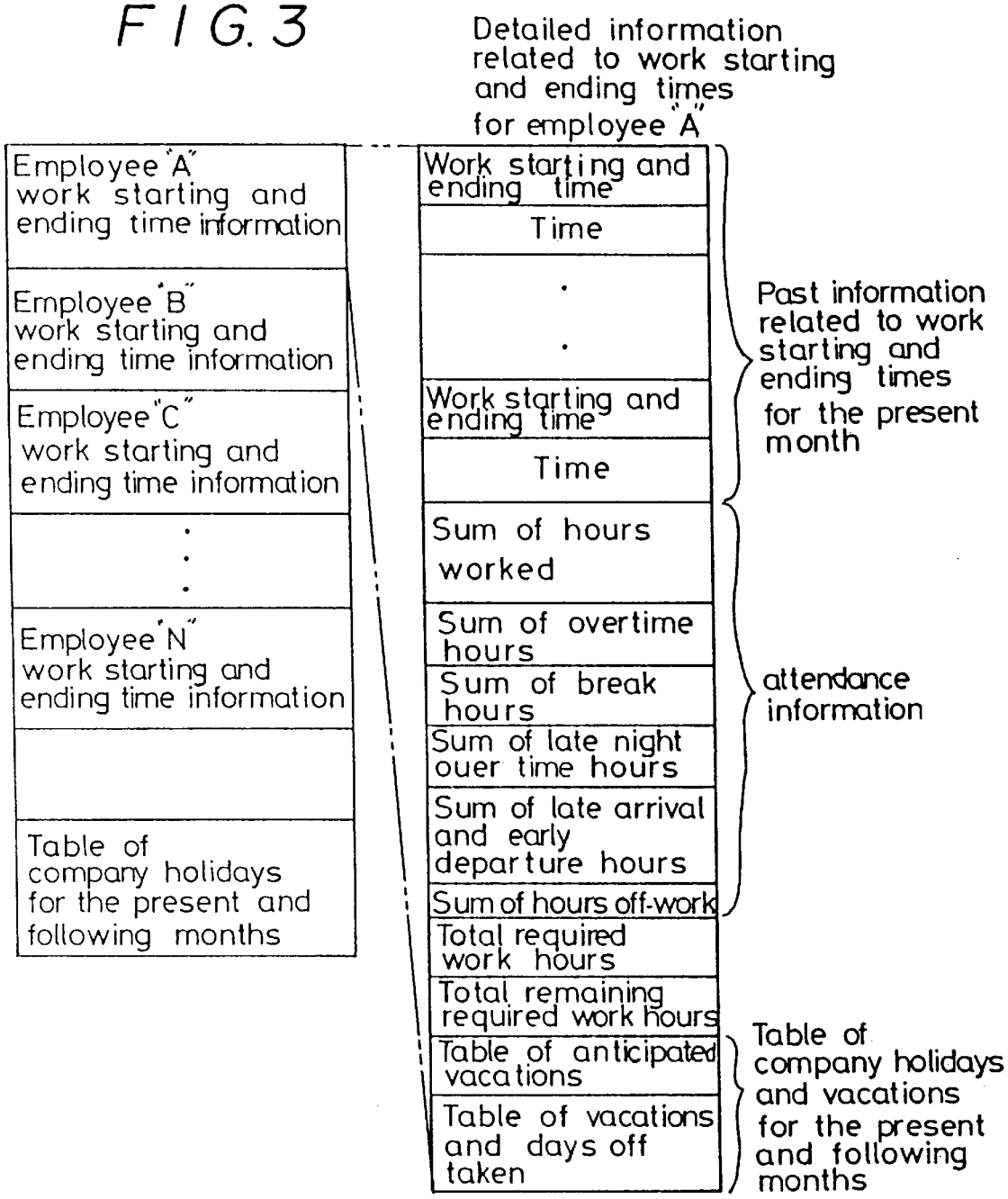
FIG. 3 shows the memory configuration of the memory circuit of an embodiment according to the present invention.

The memory circuit 4 contains a memory configuration such as shown in FIG. 3.

More specifically, the time recorder contains the information related to the work starting and ending times for each employee, and accesses this information using the individual recognition code which was read from the time card.

As indicated in FIG. 3, the information related to the work starting and ending times for each person includes the hours worked, the required working hours, and the remaining required working hours, all within the determined period.

Next, when the time card is inserted (step 2*a*), the card feeder 9 feeds the time card, and the time card recognizer 8 reads the individual recognition code from the holes punched in the time card (step 2*b*).

The control circuit 3 then determines if the individual recognition code thus read is included in the individual recognition codes stored in the memory circuit 4 (step 2*c*). If it is not included, then the time card is ejected (step 2*h*). If it is included, then the memory circuit 4 is accessed with the individual recognition code, and the information related to the work starting and ending times for that employee is read out (step 2*d*).

Next, it is determined whether the "on-duty" flag stored in the control circuit 3 is "1" or not, that is, whether the employee was on duty or not up to that point (step 2*e*).

If the "on-duty" flag is "0", it is determined that the employee is starting to work, and the following operations are executed.

The "on-duty" flag is set to "1" to indicate that the employee has begun to work, and the current time is stored as the actual work starting time in the contents of the information already read related to work starting and ending times for the employee (step 2*f*).

Then, the current time is printed in a specific starting time column of the time card (step 2*g*), and the time card is ejected (step 2*h*).

On the other hand, if the "on-duty" flag is "1" in step 2, then it is determined that the employee has finished working, and the following operations are executed.

The "on-duty" flag is set to "0" to indicate that the employee has finished working, and the current time is stored as the actual work ending time in the contents of the information already read related to work starting and ending times for the employee (step 2*i*).

Next, the control circuit 3 calculates the difference between the actual work starting time and the actual work ending time of the same day, to produce the hours worked for the day (step 2*j*).

The hours worked calculated in step 2*j* are then added to the sum of hours worked in the information already read related to work starting and ending times for the employee, that is, to the finished work hours (step 2*k*).

Then, the hours worked in that day are subtracted from the remaining required work hours in the information already read relating to work starting and end times, and a new remaining required work hours is calculated (step 2*m*).

The current time is then printed in a specific ending time column of the time card and the remaining required work hours calculated in step 2*m* is printed in the remaining required work hours column (step 2*n*), after which the time card is ejected (step 2*h*).

For example, if the hours worked on the first day of the determined period is 8 hours, then the hours printed in the remaining required work hours column would be 176.00. Then, if the hours worked on the next day is 6.50 hours, then the hours printed in the remaining required work hours column would be 169.50, thus allowing easy confirmation of the remaining required work hours.

The employee is thus able to gauge his own work progress.

Since surplus hours, such as overtime hours, are expressed as a minus remaining required work hours, easy confirmation thereof is also possible.

FIGS. 4 and 5 show embodiments of work starting times, work ending times, and remaining required work hours printed on a time card, based on the embodiment described above.

FIG. 4 shows the front of the time card, while FIG. 5 shows the back of the time card.

In FIGS. 4 and 5, the actual work starting time is printed in the starting time day 1 column, the work ending time is printed in the ending time day 1 column, and remaining number of required work hours is printed in the remaining hours column, which correspond to the current date.

Also, as indicated in FIG. 5, the required work hours (in this case, 184 hours) within the determined period (in this case, 1 month) may be printed in "Required work hours" column, and when the remaining required work hours on the final day of the determined period is minus, that minus amount may be printed as overtime hours in a "Normal overtime hours" column.

In this embodiment, since the hours in the column on the right side of the time card is −8.25, the normal overtime hours has been calculated to be 8.25.

On the other hand, the remaining required work hours which were calculated in step 2m may be displayed on a display unit 5 without being printed, or may be output by voice sound with a sound generator 6; or it may be printed while being displayed or vocalized.

In addition, the display unit 5 is not limited to an LCD, since the same effect may be achieved using a 7-segment LED, etc.

Also, in the embodiment described above, the actual work starting and ending times were detected by inserting a time card, but detection of the work starting and ending times may be also done using a magnetic card. In such a case, output of the remaining required hours is preferably done by displaying on a display unit 5, providing an audible output with a sound circuit 6, or displaying on a display unit 5 while energizing a sound circuit 6.

Since a time recorder according to the present invention includes informing means for informing personnel of the remaining required work hours which are calculated by subtracting the work hours finished within a determined period from the required hours which must be engaged within said determined period, the employee may easily confirm the remaining required work hours within the determined period, and the bother associated with such confirmation is eliminated.

In addition, when the above mentioned informing means is a printing means for printing the remaining required work hours onto a time card, the remaining required work hours within the determined period is easily confirmed. The printed information is useful in order to confirm the remaining required work hours even when it is not time for ending work.

Also, when the above mentioned informing means is display means for displaying the remaining work hours, the remaining number of required work hours may be confirmed visually.

Further, when the above mentioned informing means is a sound generating means for informing the remaining required work hours by audio voice, the remaining required work hours may be confirmed with only passive concentration.

Although the present invention has been fully described by way of example with reference to the accompanying drawings, it is to be understood that various changes and modifications will be apparent to those skilled in the art. Therefore, unless such changes are modifications depart from the scope of the invention, they should be construed as being included therein.

What I claim is:

1. A time recorder comprising:

setting means for setting required work hours which must be worked by an employee within a determined period which is greater than one day;

output means for determining remaining required work hours to be worked by said employee within said determined period by subtracting finished work hours worked within said determined period from said required work hours; and informing means for:

providing an indication of said remaining required work hours in said determined period, and providing an indication of any overtime hours worked which is greater than said set required work hours in said determined period.

2. A time recorder according to claim 1, wherein said informing means includes printing means for printing an indication of said remaining required work hours onto a time card and for printing an indication of said overtime hours onto the time card.

3. A time recorder according to claim 1, wherein said informing means includes display means for providing a visual display of said remaining required work hours.

4. A time recorder according to claim 1, wherein said informing means includes sound generating means for providing an audio indication of said remaining required work hours.

5. A time recorder comprising:

a control means;

means for inputting a number of hours that an employee is required to work, in a predetermined period which is greater than one day, into said control means;

means for inputting actual employee starting and finishing times, in said predetermined period, into said control means;

said control means comprising means for determining remaining required working hours by determining the number of hours between said starting and finishing times for each day and subtracting the result thereof from said number of hours that the employee is required to work; and means for:

communicating said remaining required working hours in said predetermined period, to said employee, and communicating any overtime hours worked which is greater than said required work hours in said predetermined period, to said employee.

6. The time recorder of claim 5 wherein said means for inputting a number of hours includes a keypad.

7. The time recorder according to claim 5 wherein said means for inputting said actual employee starting and finishing times comprises a time card input means for receiving a time card, and said means for communicating comprises means for printing said remaining working hours on said time card and for printing an indication of said overtime hours on the time card.

8. The time recorder of claim 5 wherein said means for communicating comprises a visual display.

9. The time recorder of claim 5 wherein said communicating means comprises means for generating an audible sound.

10. The time recorder of claim 5 wherein said communicating means comprises means for generating voice signals.

11. A time recorder comprising:

storage means for storing a number of hours that an employee is required to work in a predetermined period which is greater than one day;

arithmetic means for accumulating hours actually worked by said employee in said predetermined period, and for calculating remaining hours required to work by subtracting hours actually worked from said number of hours that the employee is required to work;

said arithmetic means being activated by insertion of a time card for printing work finishing time for each day; and means for:

communicating said remaining hours required to work in said predetermined period, to said employee, and communicating any overtime hours worked which is greater than said required work hours in said predetermined period, to said employee.

12. A time recorder according to claim 11, wherein said means for communicating includes printing means for printing said remaining hours required to work onto said time card and for printing an indication of said overtime hours onto the time card.

13. A time recorder according to claim 11, wherein said means for communicating includes display means for visually displaying said remaining hours required to work.

14. A time recorder according to claim 11, wherein said means for communicating includes sound generating means for providing an audio indication of said remaining hours required to work.

* * * * *